US006561219B1

(12) United States Patent
Apostolides

(10) Patent No.: US 6,561,219 B1
(45) Date of Patent: May 13, 2003

(54) PORTABLE FLUID TRANSFER CONDUIT

(75) Inventor: John K. Apostolides, Pittsburgh, PA (US)

(73) Assignee: RPM Industries, Inc., Washington, PA (US)

( * ) Notice: Subject to any disclaimer, the term of this patent is extended or adjusted under 35 U.S.C. 154(b) by 0 days.

(21) Appl. No.: 09/836,610

(22) Filed: Apr. 16, 2001

Related U.S. Application Data

(63) Continuation of application No. 09/435,375, filed on Nov. 5, 1999, now Pat. No. 6,216,732, which is a continuation-in-part of application No. 08/961,339, filed on Oct. 30, 1997, now abandoned.

(51) Int. Cl.[7] ..... G05D 9/00

(52) U.S. Cl. ..... 137/560; 137/565.25; 137/351; 184/1.5; 184/105.1

(58) Field of Search ..... 184/1.5, 196 S, 184/6.3, 105.1; 137/565.25, 351, 14, 560

(56) References Cited

U.S. PATENT DOCUMENTS

| | | | | |
|---|---|---|---|---|
| 2,029,781 A | * | 2/1936 | Mclean | 184/15 |
| 2,603,312 A | * | 7/1952 | Tabet | 184/1.5 |
| 3,583,525 A | | 6/1971 | Holcomb | 123/196 |
| 3,583,527 A | | 6/1971 | Raichel | 184/46 A |
| 3,722,623 A | | 3/1973 | Waldecker | 184/46.3 |
| 3,802,564 A | | 4/1974 | Turman | 210/134 |
| 3,858,686 A | * | 1/1975 | Luterick | 184/1.5 |
| 3,917,027 A | | 11/1975 | Hakanson et al. | 184/6.3 |
| 4,014,794 A | | 3/1977 | Lewis | 210/199 |
| 4,061,204 A | | 12/1977 | Kautz, Jr. | 184/6.3 |
| 4,094,293 A | | 6/1978 | Evans | 123/196 S |
| 4,112,910 A | | 9/1978 | Percy | |
| 4,157,744 A | | 6/1979 | Capriotti | 184/46.3 |
| 4,199,950 A | | 4/1980 | Hakanson et al. | 184/46.3 |
| 4,240,523 A | | 12/1980 | Nestor et al. | |
| 4,402,287 A | | 9/1983 | Cochran | 210/232 |
| 4,502,431 A | | 3/1985 | Lulich | 123/196 S |
| 4,502,451 A | | 3/1985 | Duprez | 123/514 |
| 4,875,551 A | | 10/1989 | Lulich | 184/46.3 |
| 4,977,978 A | | 12/1990 | Batrice | 184/1.5 |
| 5,048,578 A | * | 9/1991 | Dorf et al. | 141/346 |
| 5,056,621 A | | 10/1991 | Trevino | 123/196 A |
| 5,168,845 A | * | 12/1992 | Peaker | 123/196 S |
| 5,203,429 A | | 4/1993 | Zager | |
| 5,236,064 A | | 8/1993 | Wagoner | 184/46.3 |
| 5,257,678 A | | 11/1993 | Stokes | 184/1.5 |
| 5,263,445 A | * | 11/1993 | Bedi et al. | 123/196 S |
| 5,327,862 A | | 7/1994 | Bedi | 184/1.5 |
| 5,390,762 A | | 2/1995 | Nelson | 184/1.5 |
| 5,431,138 A | | 7/1995 | Hurner | 184/1.5 |
| 5,443,138 A | | 8/1995 | Bedi et al. | 184/1.5 |
| 5,452,695 A | | 9/1995 | Bedi | 184/1.5 |
| 5,526,782 A | | 6/1996 | Bedi et al. | 123/196 A |
| 5,566,781 A | | 10/1996 | Robert et al. | 184/1.5 |
| 5,743,231 A | * | 4/1998 | Reinosa | 123/196 S |
| 5,894,825 A | * | 4/1999 | Duerr | 123/196 S |
| 5,957,240 A | | 9/1999 | Apostolides | 184/1.5 |

FOREIGN PATENT DOCUMENTS

DE 197 43917 A1 4/1999

OTHER PUBLICATIONS

International Search Report for International Application PCT/US 02/02415, Oct. 10, 2002.

* cited by examiner

*Primary Examiner*—A. Michael Chambers
(74) *Attorney, Agent, or Firm*—Kirkpatrick & Lockhart LLP

(57) ABSTRACT

A portable fluid transfer conduit is disclosed having an elongated flexible conduit having an inlet and outlet port. A coupling is postured at the inlet port for receiving fluid from a fluid source such as prelubrication pump. A flow control member is located at the discharge end which includes an activator for controlling the flow of fluid. The flow control member may include a handheld pump where the fluid source does not have a powered flow.

7 Claims, 4 Drawing Sheets

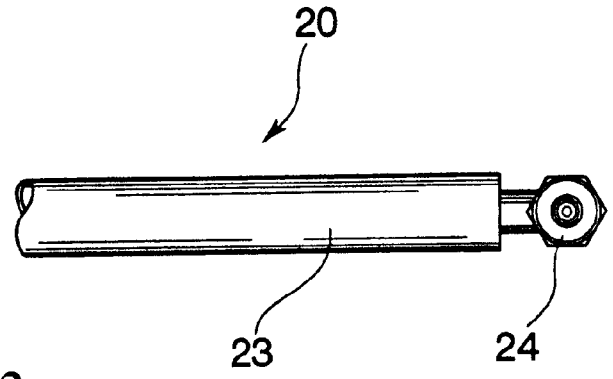
Fig. 3
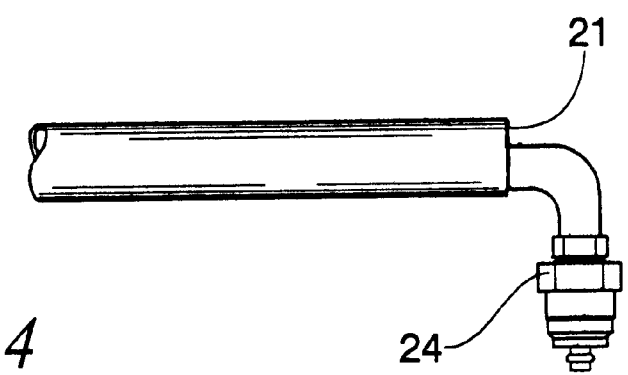
Fig. 4
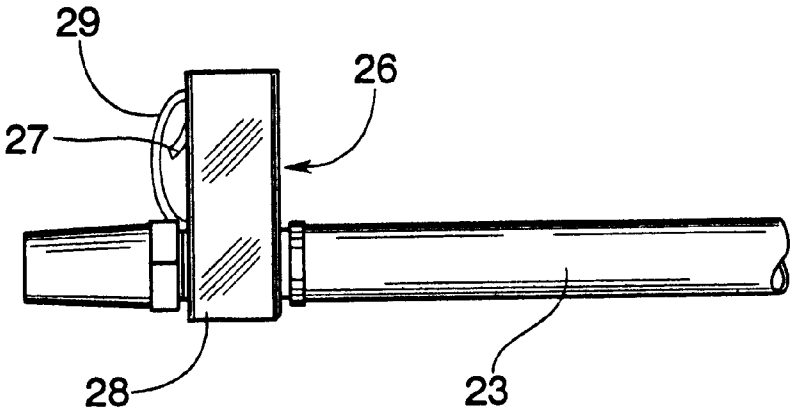
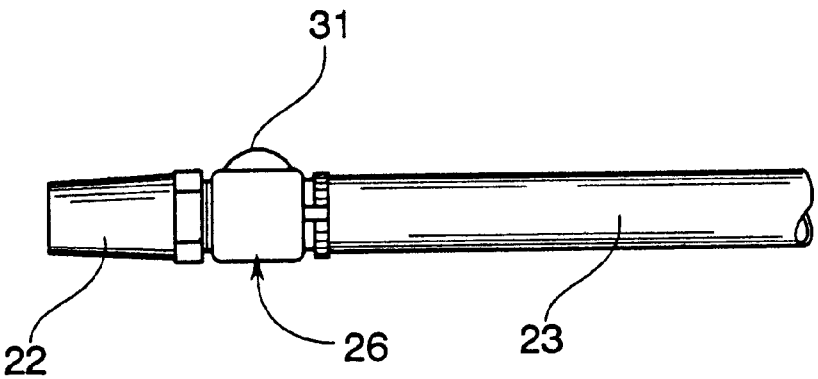

PORTABLE FLUID TRANSFER CONDUIT

CROSS REFERENCE

This application is a continuation application of U.S. application Ser. No. 09/435,375, filed Nov. 5, 1999 now U.S. Pat. No. 6,216,732, which is a continuation in part application of U.S. application Ser. No. 08/961,339, filed on Oct. 30, 1997 abandoned, entitled "Portable Fluid Transfer Conduit."

FIELD OF INVENTION

The present invention relates to fluid transfer conduit having flow control means and an adapter means for connection with a source of fluid, and, in particular, to a portable fluid transfer conduit that is. useful in the removal of fluids from equipment which do not have conveniently located outlet ports.

BACKGROUND OF THE INVENTION

Many industrial machines and equipment have requirements for fluid exchanges. Examples of these include changing the oil in motors and engines or hydraulic fluid in presses and lifting equipment. Countless other examples exist, but what is generally common to these machines or equipment is the fact that the outlet port is inconveniently located. Typically this is the result of having to remove the fluid from a sump or drainage, point that is located at the bottom of the machine to utilize gravity flow.

While the task of removal is not difficult, it is often time consuming because of the inconvenient location of the fittings. However, in a number of the newer or retrofit machines, fluid circulation pumps are provided which are external, to the machine or engine. Also, some of the newer equipment is fitted with external prelubrication devices which permit oil or fluid to commence circulation prior to the activation of the primary equipment or engine on which it is fitted. Illustrative of such devices is the prelubrication device shown in U.S. Pat. No. 4,502,431 which is incorporated herein by reference, which is typically fitted to a diesel engine used in power equipment, trucks or heavy equipment. Also, circulation devices used to heat hydraulic fluid are applicable to the present invention.

Additionally, there are numerous smaller devices and motors where access to fluid discharge ports is difficult to reach or in which the fluid must be assisted for removal. Examples include marine engines and the like. In some small sized equipment, the engine must be inverted to remove the oil or other fluid. See also U.S. Pat. No. 5,526,782, 5,257,678 and 4,977,978.

Accordingly, it is an object of the invention to provide portable fluid transfer conduit that will facilitate the removal of fluids remote from the discharge port. It is also an object of the present invention to provide a conduit for use in fluid transfer that is adapted to fit to a discharge port and remotely control the flow of fluid from an engine or equipment. Another object of the invention is to provide a portable transfer conduit that includes fluid pump means for extracting fluid from a machine or engine. A further object of the invention is adapter means for connecting the fluid transfer conduit to an outlet port for such fluid. Another object of the invention is an adapter connector for coupling an air evacuation means to purge or remove part of the fluid from the channels of the machine and filter.

SUMMARY OF THE PRESENT INVENTION

Generally, the present invention comprises a portable fluid transfer conduit having at least one flexible fluid conduit. Typically the conduit is made from a rubber or polymeric material, stainless steel braiding or the like. In most typical applications it comprises a polyethylene or propropylene tubing. The conduit includes an inlet port and an outlet port. The inlet port is adapter for connection with the discharge port of a fluid source such as the sump of an engine or a prelubrication pump. In one preferred embodiment of the invention, a coupler means is provided at the inlet port to couple the conduit with discharge port of the fluid source. Most preferably, a quick connect-disconnect fitting is secured to the outlet port of the conduit and a mateable fitting therewith at the discharge port.

A flow control means is positioned adjacent the outlet port of the conduit for controlling the flow of fluid from said source, such as a engine sump, through the conduit. In one preferred embodiment, the flow control means includes an actuator electrically connected to means for pumping the fluid from said fluid source, such as a prelubrication pump used in a diesel or internal combustion engine. In this embodiment, the flow control actuator includes disconnectable electrical connection means for control of the pump means.

In a second preferred embodiment, the flow control means comprises a pump for pumping the fluid from the fluid source through the conduit. The actuator includes electrical means such as a battery pack or connections to an external source of power such as an electrical wall outlet or battery on vehicle or equipment. The electrical connection is similar to the first embodiment in which disconnectable electric connectors are used. In the case of the battery pack or portable power source, the preferred pump is a light weight dc-motor driven pump in which a small light weight rechargeable battery pack is mounted as part of the flow control means.

In another embodiment of the invention, a quick connect conduit having a female coupling is used to connect an air gun or supply source of air pressure. The conduit includes a fitting in the line between the prelubrication pump and the system filter. This is preferably used prior to the removal of oil from the system to clear oil channels and at least some of the oil from the filter to simplify oil removal and make it safer for the workers.

While the present invention facilitates the removal of fluid from machines, engines, hydraulic systems and the like, other advantages of the invention will become apparent from a perusal of the following detailed description of presently preferred embodiments of the invention taken in connection with the accompanying drawings.

BRIEF DESCRIPTIONS OF THE DRAWINGS

FIG. 3 is a plan view of another embodiment of the invention having a pump integrally included in the flow control means;

FIG. 4 is a side elevation of the embodiment shown in FIG. 3; and

PRESENTLY PREFERRED EMBODIMENT

Figure 1:
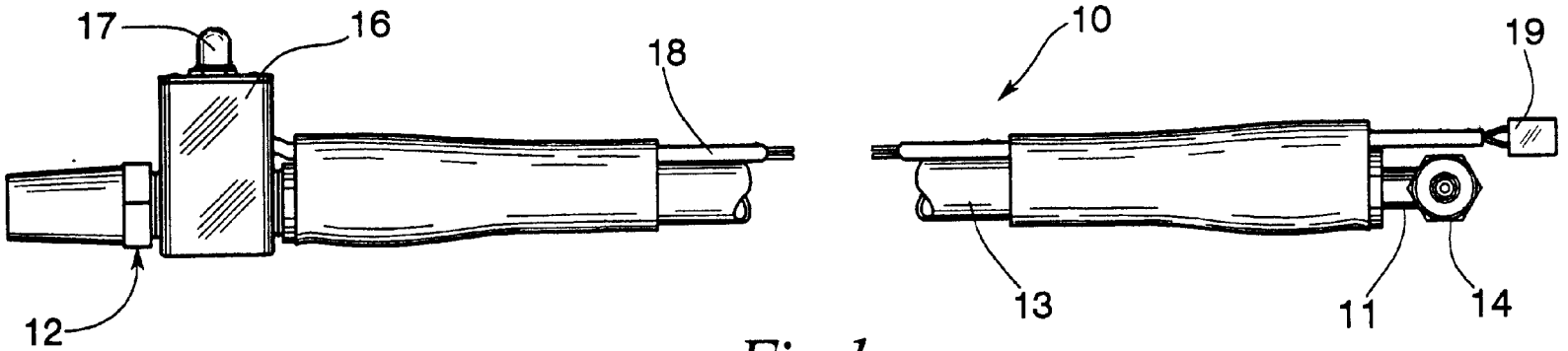
FIG. 1 is a side elevation of a presently preferred embodiment of the invention.
Figure 2:
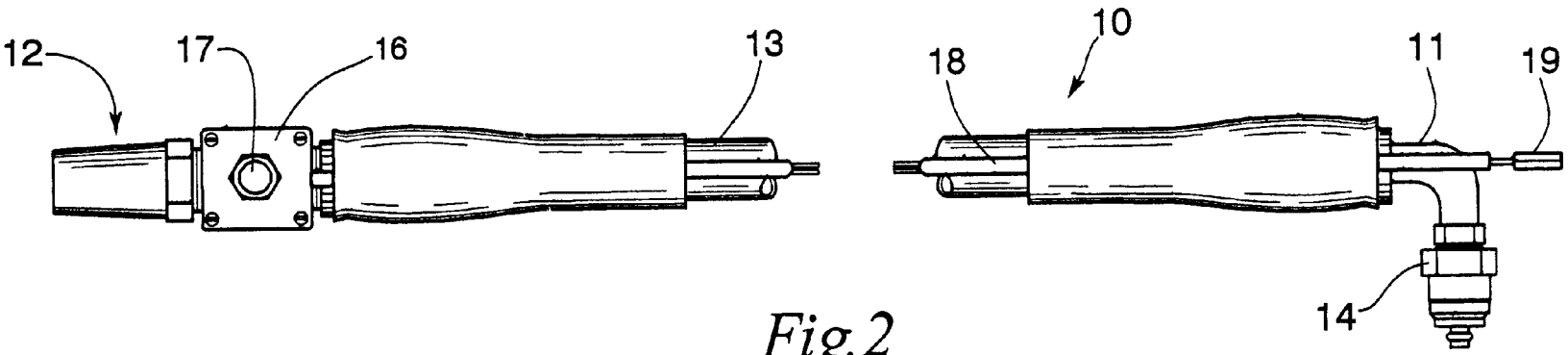
FIG. 2 is a plan view of the embodiment shown in FIG. 1 showing a quick connect coupling.

Referring to FIGS. 1 and 2, there is shown a portable fluid transfer conduit 10 having an inlet port 11 and outlet port 12.

Flexibility extending between inlet and outlet ports 11 and 12 is flexible tubing 13. Tubing 13 is preferably made from a natural or synthetic rubber material, braided stainless steel or polymeric extruded material such as polyethylene or styrene.

Attached to inlet 11 is coupling 14. As shown, coupling 14 is the male mateable end of a quick disconnect coupling more clearly shown in FIGS. 5 and 6. Alternatively, coupling 14 can be any type of fitting such as a screw in or a bayonet type coupling. Preferably, however, a quick connect fitting is adapted to the outlet of the fluid source. On devices such as a prelubrication pump similar to that shown in U.S. Pat. No. 4,502,431, a bypass or connector means is easily inserted on the pressure side of the pump to divert the oil from the engine to the fluid transfer conduit 10. An example is disclosed relative to FIGS. 5 and 6 below.

Positioned adjacent outlet port 12 is flow control means 16. Flow control means comprises in one embodiment an electric or mechanical valve for controlling the flow of fluid through the conduit activated by switch 17. This embodiment is useful where the fluid source does not incorporate a pump means and/or the fluid is gravity transferred. On the other hand, in the case where means such as a prelubrication device is used, flow control means 16 is preferably a pass through conduit having switch 17 sealably mounted thereon. Switch 17 is electrically connected by conductor 18 to electrical connector 19 which is adapted to connect with the pump circuit to activate the pump and control the flow of fluid. Where flow control means 16 comprises an electric valve, conductor 18 and connector 19 are typically connected to a source of electrical power such as a battery terminal, a magnetic switch, relay contacts or other electromechanical means for activating the pumping means.

To drain a fluid such as oil or hydraulic oil from a piece of equipment is a simple matter of connecting coupling 14 to the outlet of the pump and initiating the pump through activation of flow control switch 17 or gravity flow. It should be noted that where a prelubrication pump is used, such as in U.S. Pat. No. 4,502,431 a valve is not required. The outlet port of fluid transfer conduit 10 is positioned at a remote and convenient location to discharge the fluid into a waste oil-receiving receptacle. Such waste oil-receiving receptacles are known in the art and may commonly comprise barrels or service vehicles adapted to receive and transport waste oil or other contaminated vehicle fluids.

Figure 5:
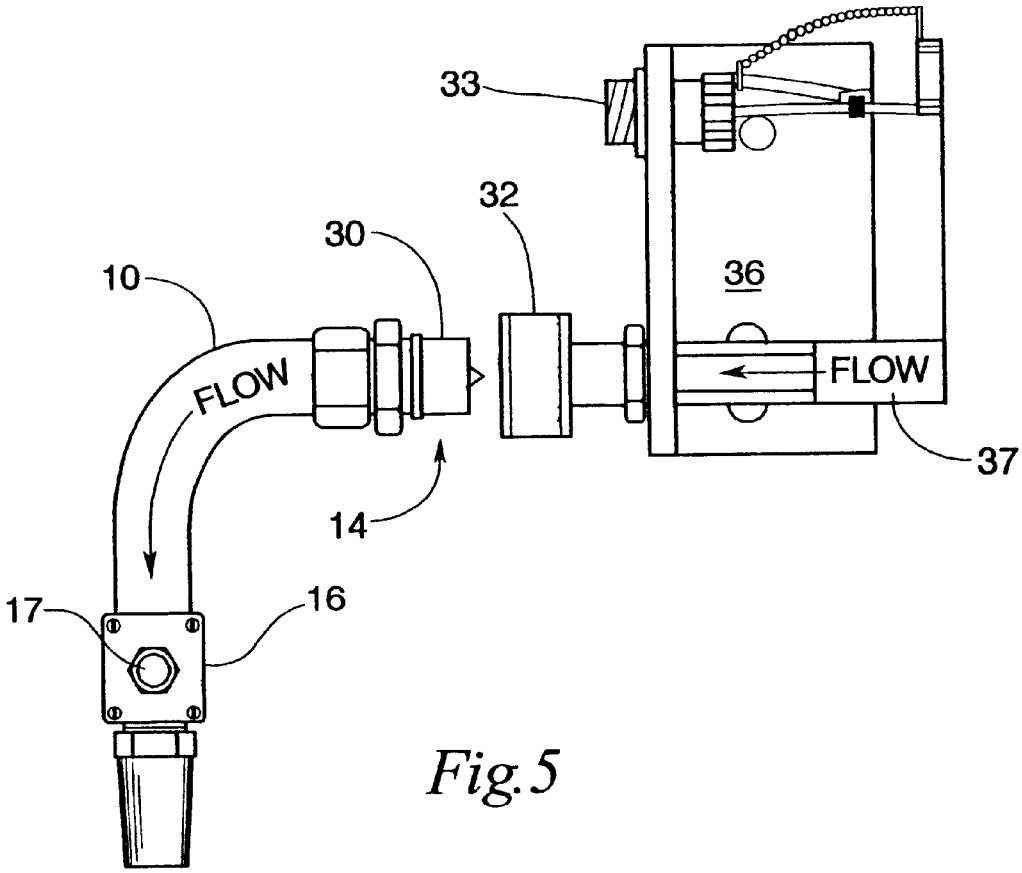
FIGS. 5 and 6 are two views of a quick connect coupling for use with the present invention.
Figure 6:
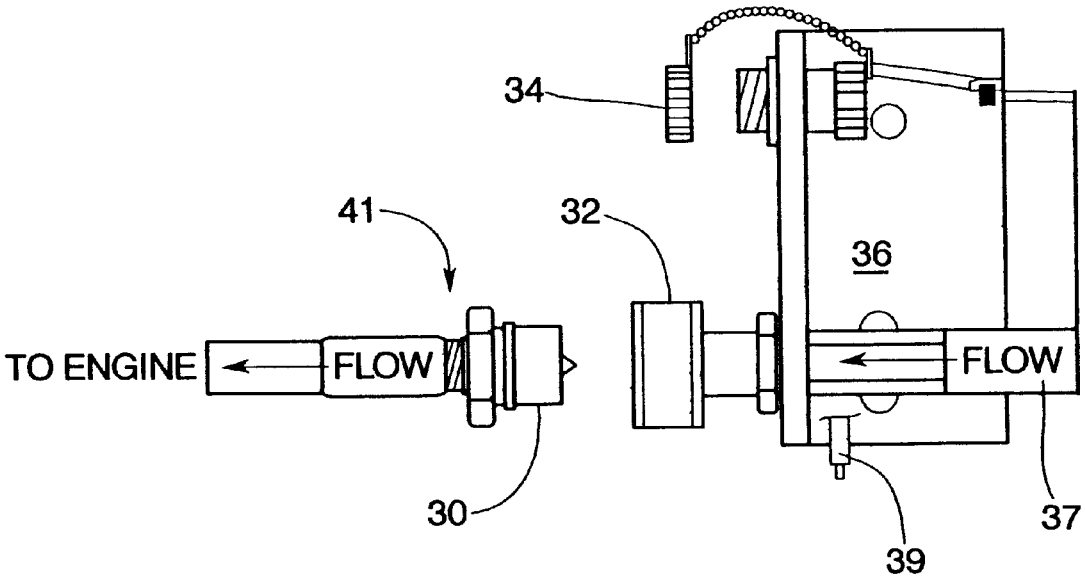

In another preferred embodiment shown in FIGS. 3 and 4, fluid transfer conduit 20 comprises a conduit 23 having an inlet port 21 and an outlet port 22. Inlet port 21 includes a coupling 24, preferably a mateable quick connect coupling as shown in FIGS. 5 and 6. In this embodiment, flow control means 16 comprises a small suction, diaphragm, piston or reciprocating pump 28 preferably including a battery pack within. Flow control means 16 includes activator switch 27 preferably in the form of a "trigger switch" having guard 29 and grip means 31 to facilitate holding the discharge end of fluid transfer conduit 20. It should be noted, however, that where a long transfer conduit is contemplated, for example 20 to 30 feet in length, it is desirable to locate the pump adjacent or in close proximity to coupling means 14.

Many types of small portable pumps 28 are commercially available on the market. A number of pumps are better suited for heavier or more viscose fluids but are not capable of being run with battery power. In such cases, a power cable such as conductor 18 and connector 19 can be used in this embodiment as well. Typically, the electrical power required can be supplied by a vehicle storage battery or an a-c pump can be connected to an a-c outlet.

The smaller pump means are especially useful in the consumer market and the larger pumps are specially applicable to the industrial market.

Referring to FIGS. 5 and 6 an example of a preferred coupling means 14 and 41 are respectively shown. Coupling means 14 and 41 are adaptable to both fluid transfer conduit embodiments shown with respect to FIGS. 1 and 3. Coupling 41 connects to the engine oil port (not shown) whereas coupling 14 is attached to conduit 10. Such couplings are well known in the art and comprise a male quick connector fitting 30 and a female mateable quick connector fitting 32. Also shown is an electrical receptor 33 for receiving electrical connector 19. It is also possible to include a sensing means on the coupling to indicate that the sump is dry and signal for shut down of the pump. A cap 34 is shown for protecting receptor 33 between periods of use. As shown in FIGS. 5 and 6, receptor 33 and fitting 32 are mounted on a bracket 36 which is then connected to a source of fluid 37, such as a prelubrication pump, not otherwise shown. In this embodiment, fitting 32 is connected in the output or high pressure side of the fluid source system. In the case of a prelubrication system, fitting 32 is interposed in the high pressure pump discharge line between pump and an engine.

As shown in FIG. 6 is a sampling port 39 can used to sample oil in a prelubrication system where the prelubrication pumps flows in to 37. This has the advantage of providing a live sample of oil without requiring the engine to be running.

Figure 7:
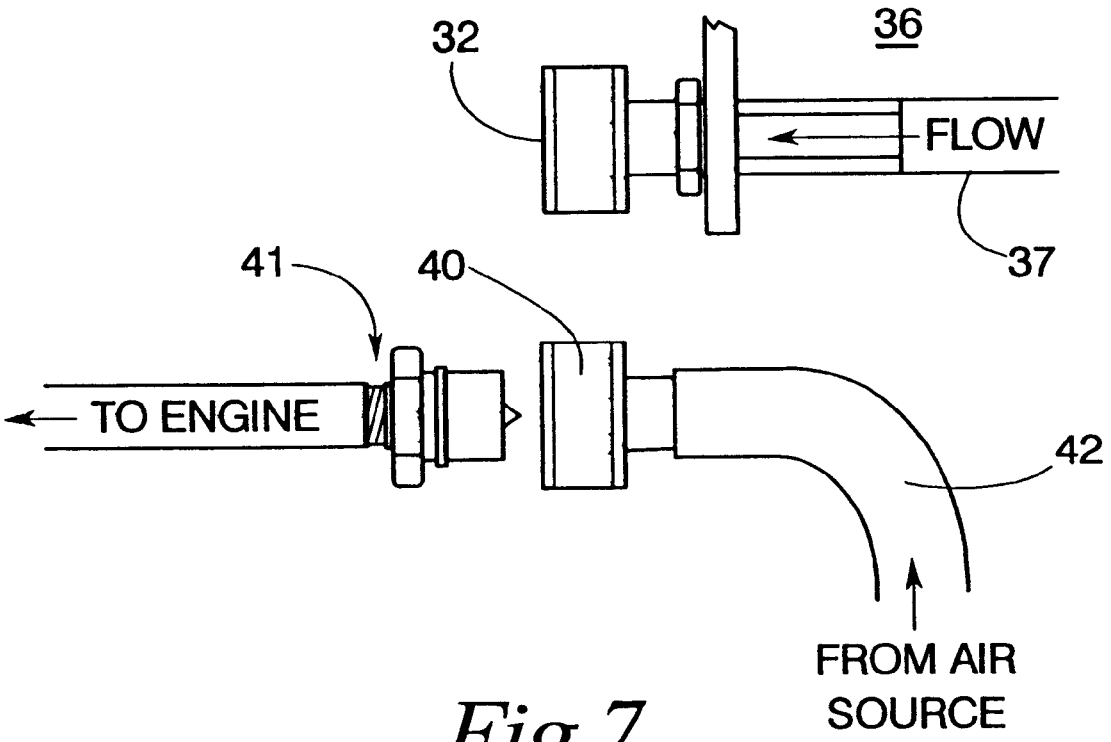
FIG. 7 is diagrammatic view of a conduit, a quick connect coupling for oil purges.

As shown in FIG. 7, an additional fitting 40 attached to air supply 42 is mounted on bracket 36. Preferably fitting 40 is quick connect female fitting adapted to couple to air supply (not shown). By attaching an air source to fitting 40 prior to the removal of oil from the engine, oil resident in the channels can be removed to the sump and the oil in the filter system at least partially removed to facilitate removal of the filter, especially if it is hot, Typically, it is desireable to have the source of air at a pressure from about 90 to 150 Psi.

While presently preferred embodiments of the invention have been shown and described in particularity the invention may be otherwise embodied with in the scope of the appended claims.

What is claimed is:

1. A method of replacing fluid in a fluid system within a vehicle engine in a vehicle that has a supplemental pump on the engine or vehicle that is operably connected to the fluid system, said method comprising:

providing a quick connect coupling having a first quick connect coupling portion in fluid communication with the fluid system and a second quick connect coupling portion in fluid communication with the discharge of the supplemental pump;

attaching a source of air pressure to the first quick connect coupling portion;

applying air pressure from the source of air pressure through the first quick connect coupling portion and into the fluid system;

discontinuing said application of air pressure;

disconnecting the source of air pressure from the first quick connect coupling portion;

attaching a conduit to the second quick connect coupling portion;

activating the supplemental pump to pump fluid from the fluid system through the second quick connect coupling portion and through the conduit wherein it discharges therefrom;

deactivating the supplemental pump;

detaching the conduit from the second quick connect coupling portion;

admitting replacement fluid from a source of replacement fluid through the first quick connect coupling portion and into the fluid system;

disconnecting the source of replacement fluid; and connecting the first quick connect coupling portion to the second quick connect coupling portion.

2. Fluid changing apparatus for an engine having a fluid system, said fluid changing apparatus comprising;

a portable conduit having an outlet end and an inlet end;

a first quick disconnect portion attached to said inlet end of said portable conduit;

a third quick disconnect portion coupled to the engine that communicates with the fluid system;

a portable handheld flow controller mounted to said portable conduit; and a mounting bracket supporting a second quick disconnect portion coupled to a discharge port of a pump arranged to pump a fluid to said fluid system, said second quick disconnect portion adapted to be removably coupled to said third quick disconnect portion during normal operation of the engine, or to said first quick disconnect portion to remove fluid from said fluid system.

3. The fluid changing apparatus of claim 2 wherein said portable flow controller is electrically powered and wherein said fluid changing apparatus further comprises:

an electrical receptor mounted to said mounting bracket and coupled to a source of electrical energy; and an electrical connector coupled to said portable flow controller and removably connectable to said electrical receptor.

4. The fluid changing apparatus of claim 3 further comprising a detachable cap for affixing to said receptor when said electrical connector is not coupled thereto.

5. The fluid changing apparatus of claim 2 wherein said pump comprises a prelubrication pump.

6. The fluid changing apparatus of claim 2 further comprising a sampling port in a portion of conduit extending between the discharge port of the pump and said second quick disconnect portion.

7. The fluid changing apparatus of claim 2 wherein said second quick disconnect portion comprises a valve.

* * * * *